US005419443A

United States Patent [19]

Niederberger et al.

[11] Patent Number: 5,419,443

[45] Date of Patent: May 30, 1995

[54] HOLDER FOR TOOLS AND OTHER OBJECTS

[75] Inventors: Alfred Niederberger, Grenchen; Beat Buerki, Selzach, both of Switzerland

[73] Assignee: Sobex AG, Selzach, Switzerland

[21] Appl. No.: 221,187

[22] Filed: Mar. 30, 1994

[30] Foreign Application Priority Data

May 24, 1993 [DE] Germany ..... 43 17 238.5

[51] Int. Cl.[6] ..... A47F 5/00

[52] U.S. Cl. ..... 211/70.6; 211/89

[58] Field of Search ..... 211/70.6, 89, 65, 63, 211/66, 67, 68, 70.8, 120

[56] References Cited

U.S. PATENT DOCUMENTS

| | | | |
|---|---|---|---|
| 2,569,021 | 9/1951 | Rozanski | 211/89 X |
| 2,707,052 | 4/1955 | Brown | 211/89 X |
| 3,812,976 | 5/1974 | Rempel | 211/70.6 |
| 4,936,469 | 6/1990 | Drower | 211/89 X |
| 5,005,710 | 4/1991 | Hofer | 211/70.6 |

FOREIGN PATENT DOCUMENTS 3490321 4/1992 Germany .

8604291 7/1986 WIPO .

*Primary Examiner*—Ramon O. Ramirez
*Assistant Examiner*—Sarah L. Purol
*Attorney, Agent, or Firm*—McAulay Fisher Nissen Goldberg & Kiel

[57] ABSTRACT

Holder for tools and other objects is provided which substantially includes at least one rail having a uniform cross section along its longitudinal dimension and a plurality of holding devices fastened thereto. Each holding device is formed by a strip of determined length and width which is produced from resilient material and has fastening means at both ends. The fastening means are adapted to the rail and constructed for arrangement thereon. The holding device is bent in a U-shape and fastened at the rail so as to be displaceable in the longitudinal direction of the rail by its ends which form legs. The strip is constructed so that the center region of its length is narrower than the two end regions forming the legs and stiffening means are arranged on the inner side of the strip in the center of the wider end regions, which stiffening means project into the interior formed by the U-shaped strips and are directed toward the base of the rail.

8 Claims, 3 Drawing Sheets

HOLDER FOR TOOLS AND OTHER OBJECTS

BACKGROUND OF THE INVENTION

1. Field of the Invention

The invention is directed to a holder for tools and other objects substantially including at least one rail having a uniform cross section along its longitudinal dimension and a plurality of holding devices fastened thereto. Each holding device is formed by a strip of determined length and width which is produced from resilient material and has fastening means at both ends, which fastening means are adapted to the rail and constructed for arrangement thereon, the holding device being bent in a U-shape and fastened at the rail so as to be displaceable in the longitudinal direction of the rail by its ends which form legs.

2. Background Art

Such a holder can be used .to hold and store tools in particular, but also other objects which, depending on their size and/or shape, are either hung and inserted in the U-shaped strips or are pressed in between contacting legs of adjacent U-shaped strips. Tools in the form of pliers can also be hung in such a U-shaped strip by one of the handles, the other handle being arranged outside the U-shaped strip, so that the tool "rides", as it were, or straddles the upper edge of the U-shaped strip.

The distinguishing feature of such a holder which has a plurality of strips which are bent in a U-shape consists in particular in that tools of a wide range of sizes and shapes can be held on or in it. Of course, the structural dimensions of the strips or the holder as a whole also play a part in this. For example, when the strip-shaped holding devices are of sufficient size, gardening implements can also be fastened to or held by such a holder, specifically in such a way that the implement itself stands on the floor of a room, but is inserted by its handle between the holding devices of a holder fastened at a certain height on the wall of this room.

Another special feature of such a holder consists in that its holding capability is further increased as the number of objects inserted between the holding devices increases. This is because the U-shaped strips are arranged so as to be displaceable at the rail by fastening means constructed at their two ends, i.e. when an object is pressed between two holding devices, these two holding devices move together with their adjacently contacting legs and are displaced in the rail.

This is also the reason why objects of different thickness can be fastened at the holder without overburdening the legs of the holder.

However, this displaceable design of the legs of the holding devices in the rail has the disadvantage that when objects having only a few small dimensions are fastened between the holding devices the spring force between the latter is not sufficient to hold the objects permanently, particularly when such a holder is provided, for example, in vehicles which are exposed to constant vibrations when driving.

To solve this problem it has already been suggested in the German Patent 34 90 321 to insert inside each U-shaped holding device a separate, smaller supporting member formed by a resilient body which is also bent in a U-shape and whose legs contact the inner sides of the holding device in such a way that the supporting member increases the pressing force acting on the object fastened in the holder.

Although this combination of a holding device with a supporting member which is arranged inside the latter and has an appearance very similar to that of the holding device overcomes the disadvantage described above, it has the further disadvantage that the interior of the holding device is reduced in size and filled up in such a way that the hanging of a tool having two handle parts, e.g. pliers, which was described above is more difficult or even impossible.

This disadvantage is avoided in a holder described in EP 0 211 018 in that the gripping jaws which are constructed as strips are more elastically resilient at their flanks and increasingly so toward the base than in their curved center part and in that the strips of resilient material forming the holding devices have a wider center part so that the resisting moment or section modulus is greater in this center part than at the two end portions forming the legs of the U shape.

The wider construction of the strips in their center region gives the narrower ends of the respective strips a greater spreading inclination and accordingly increases the springing or clamping force between the respective holding devices.

However, this construction has the disadvantage that tools, e.g. pliers, which are hung by means of these holding devices tend to slip laterally because of the curved construction in particular of the upper edge of the U-shaped strip serving to support the tool, i.e. the tool does not remain in the center of the U-shaped center part of the holding device, but rather shifts in the direction of the next holding device located to the right or left of the latter and accordingly prevents the free insertion of another object, e.g. a screw driver, between the legs of two such adjacent holding devices.

OBJECT AND SUMMARY OF THE INVENTION

The primary object of the present invention is to avoid the disadvantages occurring in the embodiment forms of known holders described above and to provide a holder which can receive and hold objects and particularly tools of a wide range of designs so that the latter do not impede the handling of the holder and in particular maintain their original position when inserted or hung.

This object, as well as others, is met in a holder of the type mentioned above in that the strip is constructed so that the center region of its length L is narrower than the two end regions forming the legs and in that stiffening means are arranged on the inner side of the strip in the center of the wider end regions, which stiffening means project into the interior formed by the U-shaped strips and are directed toward the base of the rail.

As a result of this narrower construction of the center portion of the strips, tools which are suspended in this location, e.g. pliers, remain in this region and do not move into the lateral region of the holding device, e.g. when the holder is exposed to shaking or vibrations, so as to prevent the insertion of other objects between the adjacent legs of the holding device in question. The more flexible construction of the U-shaped holding device brought about by this step is compensated for in that these holding devices have stiffening means which are activated when the legs of the holding device in question are pressed together more forcefully and accordingly increase the clamping force between adjacent holding devices. On the other hand, since these stiffening means are directed toward the rail, they do not fill up the interior of the U-shaped holding device in such a way that the insertion or hanging of another object in the holding device is impeded or even made impossible. On the contrary, an object which is inserted into the interior further activates the stiffening means, since these stiffening means are pressed against the legs of the holding device by the object and accordingly tension them.

At least the upper edge in the center region of the strip advantageously has a curved indentation. As a result of this construction of the center region of the strips, the suspended tools, e.g. pliers, slip into the center position of the holding device and remain there solely by the influence of their weight, even if they were not suspended exactly in the center region, so that there is always enough room left over for pressing in another tool between two adjacent holding devices without first having to shift a tool which is already suspended in the holding device.

In an advantageous further development, both the upper and lower edge of the strip have curved indentations in the center region. This "symmetrical" construction of the strip, so to speak, facilitates the manufacture of the holder according to the invention. That is, there is no need to make sure that the edge with the curved indentation is always inserted at the top when inserting the strip into the rail. In particular, this can reduce the time required for manufacturing a holder.

In a further development according to the invention, the stiffening means are constructed so as to form one piece with the strip. Such a construction is possible particularly when the holding devices are produced from plastic. The stiffening means can then be produced together with the entire holding device in a simple injection molding process without intermediate steps.

The stiffening means are advantageously constructed as tabs or tongues which are formed out from the strip. As a result of such a construction, a recess is formed in each of the two legs of the strip so that the end regions of the holding device become more flexible. But this flexibility does not impair the holding capability of the holding devices, since it is offset in every case by the stiffening means which project into the interior of the holding device when the legs of the holding devices are pressed together by the insertion of tools, etc. The flexibility of the legs of the holding devices which is achieved by forming out the tongue-shaped stiffening means is advantageous even when the holder is filled with a large number of objects inserted between the holding devices, and the holding devices are accordingly even forcefully pressed together.

In another advantageous construction, the stiffening means contact the base of the rail and are supported on the latter. The more forcefully the holding devices are pressed together by inserted objects, the greater the degree to which the stiffening action of the stiffening means is activated in that these stiffening means are not only supported relative to one another, but are also supported on the base of the rail and accordingly support the respective legs of the holding devices from the inside.

The stiffening means are advantageously constructed as additional holding devices for objects. Since the stiffening means project into the interior, which is adjacent to the rail and formed by the U-shaped strip, and accordingly divide this interior into smaller partial spaces of various sizes, they themselves are suited to serve as additional holding devices for objects whose dimensions would otherwise allow them to fall through the interior of the U-shaped strip.

In a further advantageous construction of the invention, the rail has a substantially U-shaped profile in which the free ends of the two legs are each bent inward at right angles.

This cross-sectional construction of the rail ensures a secure holding of the fastening means which are constructed at the ends of the strips and adapted to the interior of the rail profile.

Embodiment examples of the holder according to the invention are explained in more detail with reference to the drawings and the invention is pointed out in the appended claims.

DESCRIPTION OF THE PREFERRED EMBODIMENTS

Figure 3:
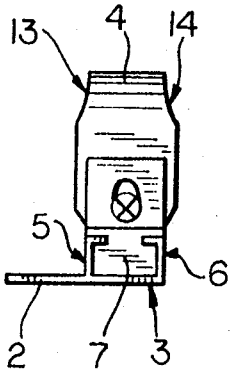
FIG. 3 shows a side view of such a holder.
Figure 1:
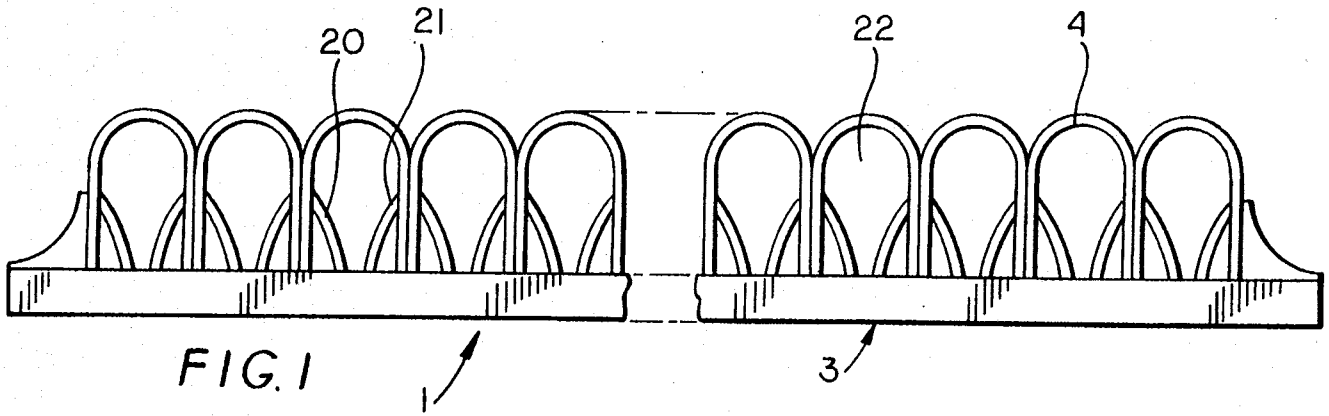
FIG. 1 shows a top view of a holder having a plurality of holding devices.
Figure 2:
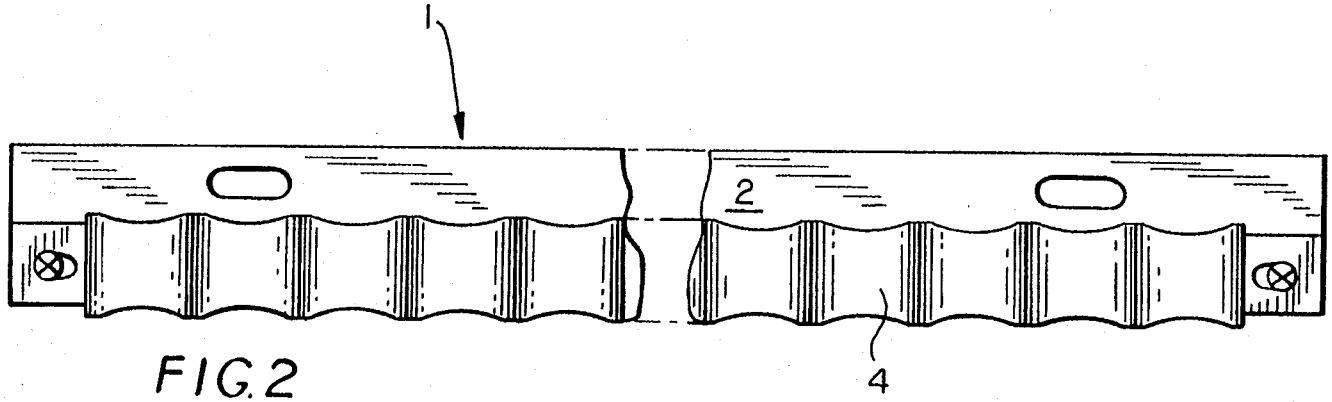
FIG. 2 is a front view of such a holder.

The holder 1 or 1' substantially includes a rail 3 or 3' which is to be fastened to a wall by a flange 2 or 2' and in which a plurality of U-shaped holding devices 4 or 4' are fastened. The embodiment forms of the holders 1 and 1' differ only in the construction of the holding devices 4 and 4'. Therefore, only holder 1 will be described in the following.

As shown in FIG. 3, the rail 3 has a U-shaped profile whose legs 5 and 6 are bent toward one another at the free ends by 90°.

The U-shaped holding device 4 projects into the interior 7 of the U-shaped profile of the rail 3 with fastening means 8 adapted to this profile and are longitudinally displaceable in the rail 3.

Figure 4:
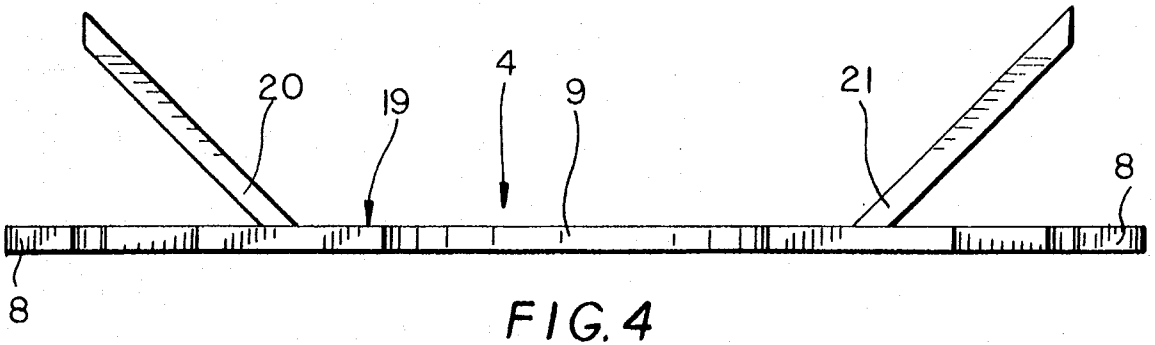
FIG. 4 shows a top view of a holding device which is stretched out flat.
Figure 5:
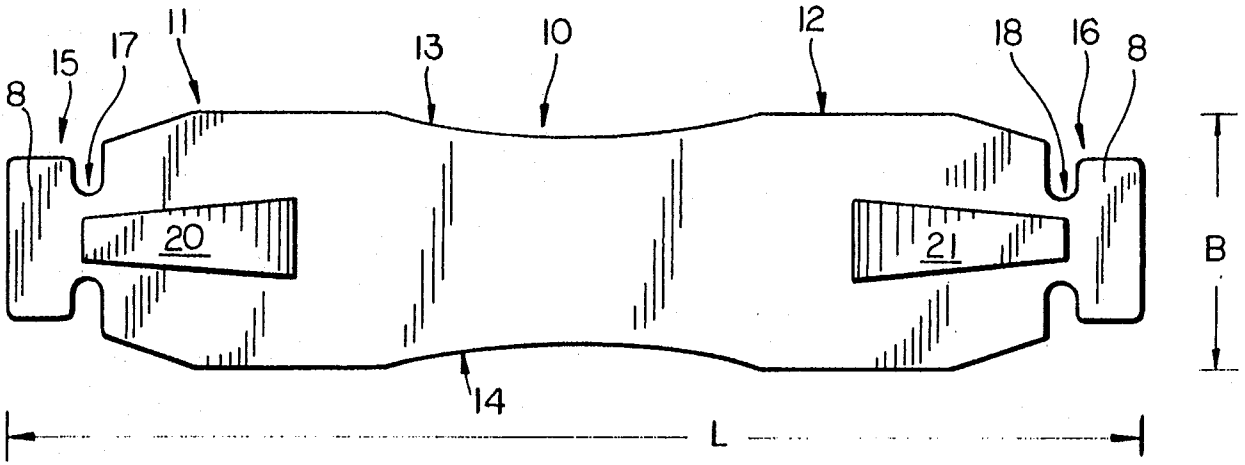
FIG. 5 is front a view of such a holding device.

The holding devices 4 are preferably produced from a resilient plastic and are substantially constructed as a strip shape 9 of determined length L, width B, and thickness D as shown in FIGS. 4 and 5. These dimensions are variable, i.e. they can be selected depending on the tools or objects to be held by the holder.

Figure 8:
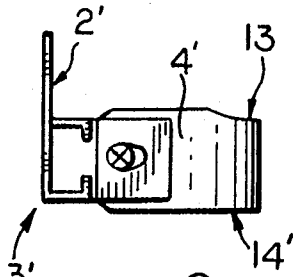
FIG. 8 shows a side view of a holder according to FIG. 7.
Figure 7:
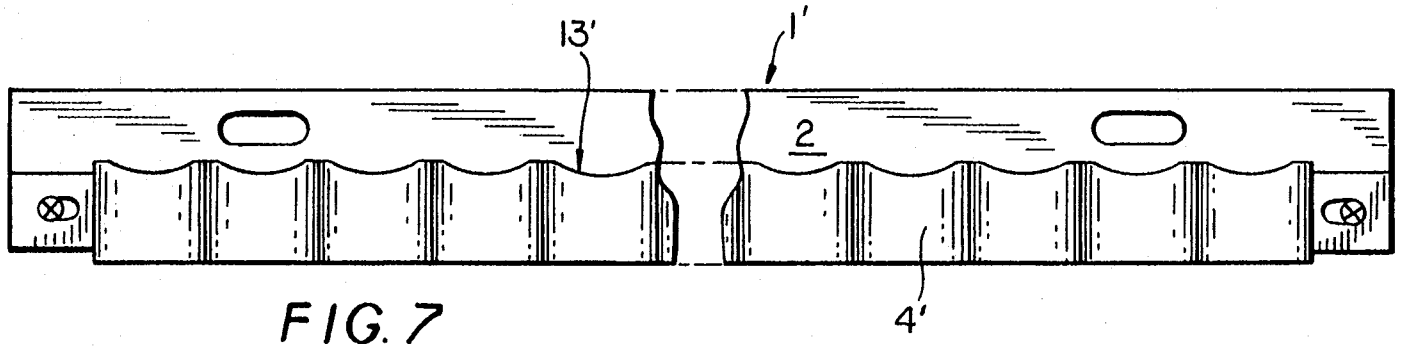
FIG. 7 is a front view of another embodiment form of the holder.
Figure 9:
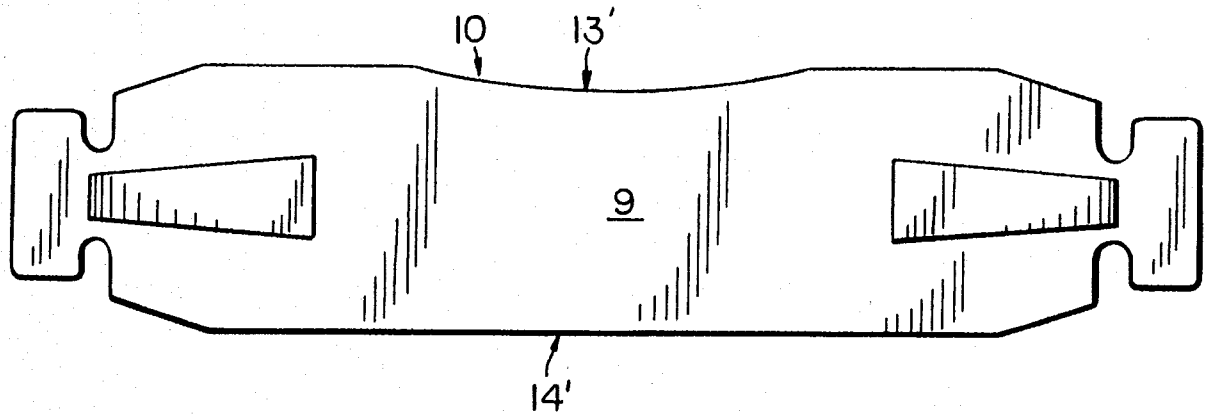
FIG. 9 shows a top view of a holder of the other embodiment form which is stretched flat.

The strip 9 forming each individual holding device 4 is not constructed so as to have a uniform width B along its length L, but rather so that its center region 10 is narrower than its end regions 11 and 12 which form its legs. This narrowing in the center region 10 is formed by curved indentations of the edges 13 and 14, although it would also be sufficient if only the upper edge 13' were indented in this shape and the lower edge 14' were constructed in a straight line as shown in FIGS. 7, 8 and 9.

The fastening means 8, which are constructed at the ends 15 and 16 of the holding device 4 for fastening same, correspond in shape to the interior 7 of the U-shaped profile of the rail 3 and consequently have notches 17 and 18 into which the inwardly bent ends of the legs 5 and 6 of the rail 3 project so as to prevent the holding device 4 from falling out of or being torn out of the rail 3.

Figure 6:
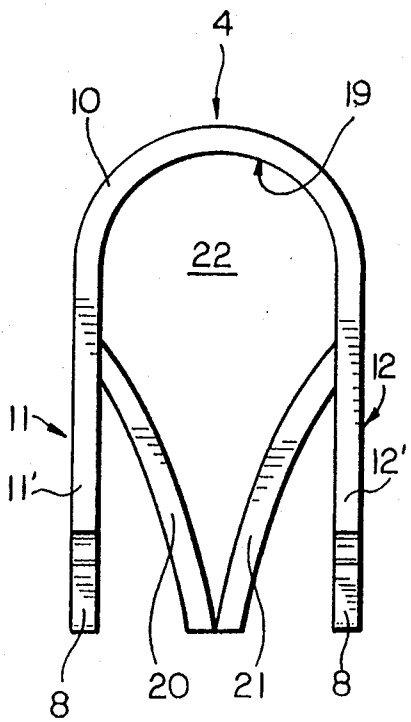
FIG. 6 shows a top view of a U-shaped holding device.

Stiffening means 20 and 21 are provided on the inner side 19 of the holding devices 4 in the center of the wider end regions 11 and 12. When the U-shaped holding device 4 is installed in the rail 3, as shown in FIG. 6, these stiffening means 20 and 21 are directed toward one another and toward the rail and contact one another.

These stiffening means 20 and 21 approach one another or come to rest against one another increasingly the more the end regions 11 and 12 or the legs 11' and 12' of the holding devices 4 formed by the latter are pressed together, e.g. by clamping a large number of objects between the respective legs 11 and 12 of the holding devices 4. The stiffness of the holding devices 4 with respect to their legs 11' and 12' increases in that the stiffening means are supported against one another or also on the base of the rail 3, so that the clamping force between the respective adjacent holding devices 4 and accordingly the holding force for objects arranged between the latter is increased.

Moreover, these stiffening means 20 and 21 can serve as additional holding devices for smaller objects which would otherwise fall through the interior 22 of the holding devices 4 when inserted in the latter because of excessive clearance. However, if such an object is larger than the inner clearance between the stiffening means 20 and 21 and the center region 10 of the holding device 4, the pressure on the stiffening means 20 and 21 is further increased by pressing in the object so that a further increase in the clamping force between the legs 11' and 12' of the holding device 4 is achieved within the meaning of the invention.

The curved indentations 13 and 14 in the center region 10 of the holding devices 4 ensure that objects which are hung in this region, e.g. pliers which project into the interior 22 of the holding device 4 with one handle and whose other handle hangs freely outside, slide to the lowest point of these indentations 13 and 14 due to their inherent weight and accordingly adjust themselves exactly in the center of each holding device 4 in each instance. This means that they do not slide to the adjacent holding device, i.e. to the intermediate spaces between the legs of the holding devices, as in holding devices of the prior art, thus preventing the insertion of other objects between two holding devices.

While the foregoing description and drawings represent the preferred embodiments of the present invention, it will be obvious to those skilled in the art that various changes and modifications may be made therein without departing from the true spirit and scope of the present invention.

What is claimed is:

1. A holder for tools and other objects comprising:

at least one rail having a uniform cross section along its longitudinal dimension;

a plurality of holding devices fastened to said rail, each holding device being formed by a strip of determined length and width which is produced from resilient material;

fastening means being provided at ends of said strip which means are adapted to the rail and constructed for arrangement thereon;

each holding device being bent in a U-shape and fastened at the rail so as to be displaceable in the longitudinal direction of the rail by its ends which form legs;

said strip being constructed so that a center region of its length is narrower than said two end regions forming the legs; and stiffening means being arranged on an inner side of said strip in the center of the wider end regions, which stiffening means project into the interior formed by the U-shaped strips and are directed toward the base of the rail.

2. The holder according to claim 1, wherein at least the upper edge in the center region of said strip has a curved indentation.

3. The holder according to claim 1, wherein both the upper and lower edges have curved indentations in the center region of said strip.

4. The holder according to claim 1, wherein said stiffening means are constructed integrally with the strip.

5. The holder according to claim 4, wherein said stiffening means are constructed as tongues which are formed out from the strip.

6. The holder according to claim 1, wherein said stiffening means contact the base of the rail and are supported on the latter.

7. The holder according to claim 1, wherein said stiffening means are constructed as auxiliary holding means for smaller objects.

8. The holder according to claim 1, wherein said rail has a substantially U-shaped profile in which the free ends of the two legs are bent inward at right angles.

* * * * *